US007950436B1

(12) United States Patent
Mullet et al.

(10) Patent No.: US 7,950,436 B1
(45) Date of Patent: May 31, 2011

(54) ROOM DARKENING SYSTEM AND METHOD

(75) Inventors: Willis Jay Mullet, Gulf Breeze, FL (US); Christopher Lee Wysoczynski, Gulf Breeze, FL (US); Steven Karl Maurer, Pensacola, FL (US); Richard Scott Hand, Pace, FL (US); Doug Real, Pensacola, FL (US); Darrin Anthony Trapani, Pensacola, FL (US)

(73) Assignee: Homerun Holdings Corporation, Pensacola, FL (US)

( * ) Notice: Subject to any disclaimer, the term of this patent is extended or adjusted under 35 U.S.C. 154(b) by 217 days.

(21) Appl. No.: 12/315,543

(22) Filed: Dec. 4, 2008

(51) Int. Cl.
*A47H 1/00* (2006.01)

(52) U.S. Cl. ..... 160/85; 160/120

(58) Field of Classification Search ..... 160/85, 160/86, 121.1
See application file for complete search history.

(56) References Cited

U.S. PATENT DOCUMENTS

| | | | | |
|---|---|---|---|---|
| 545,655 | A * | 9/1895 | Jones | 160/239 |
| 687,870 | A * | 12/1901 | Watkinson | 160/85 |
| 2,948,407 | A * | 8/1960 | Wiszuk | 211/105.3 |
| 4,766,941 | A | 8/1988 | Sloop et al. | |
| 4,865,107 | A | 9/1989 | Dube | |
| 5,392,549 | A * | 2/1995 | Castro | 40/518 |
| 5,547,008 | A | 8/1996 | Sullivan | |
| 5,566,736 | A | 10/1996 | Crider et al. | |
| 5,752,557 | A | 5/1998 | Crider et al. | |
| 5,785,105 | A | 7/1998 | Crider et al. | |
| 5,960,847 | A | 10/1999 | Crider et al. | |
| 7,281,561 | B2 | 10/2007 | Anderson et al. | |
| 2009/0159218 | A1 * | 6/2009 | Duineveld | 160/121.1 |

* cited by examiner

*Primary Examiner* — Blair M. Johnson
(74) *Attorney, Agent, or Firm* — J. Nevin Shaffer, Jr.

(57) ABSTRACT

A room darkening screen apparatus includes a shade roll. A shade with a first end and a second end is provided wherein the first end is connected with the shade roll and the second end is connected with a bottom bar. A header is connected with the shade roll and a folding rod is connected with the header such that the folding rod, when released from the header, folds the shade.

20 Claims, 4 Drawing Sheets

ROOM DARKENING SYSTEM AND METHOD

FIELD OF THE INVENTION

This invention relates to a room darkening screen system and method. In particular, in accordance with one embodiment, the invention relates to a room darkening screen apparatus including a shade roll. A shade is provided with a first end and a second end where the first end is connected with the shade roll and the second end is connected with a bottom bar. A header is connected with the shade roll and a folding rod is connected with the header such that the folding rod, when released from the header, folds the shade.

BACKGROUND OF THE INVENTION

A difficulty arises when attempts are made to temporarily cover an opening. By way of example only and not by limitation, windows, glass doors and the like are provided in homes and offices to allow light in and a view out. However, on occasion it is useful or necessary to cover the opening and sometimes it is required to fully "black out" the opening. As used herein, the term "black out" is used to describe a condition where an opening is covered sufficiently to allow essentially no or very little light to pass. Then, again, there are situations where some light is desired but the view in or out is required to be obscured. Then also, there are times when full visibility is desired and no covering is wanted.

Further, it is important for an opening covering system to be as quiet as possible and as compact as possible. The system should not be overly complex to install and maintain and it should be easily adaptable to openings with different dimensions.

A wide variety of devices have been developed in attempts to address at least some of these requirements. Sloop et al., U.S. Pat. No. 4,766,941, discloses an electrically powered oppositely positioned pair of rollers, one at the top of the window and one at the bottom, with a shade in between and covering a window opening. Likewise, Dube, U.S. Pat. No. 4,865,107, discloses a pair of shade rollers located within a double glazed window assembly. Sullivan, U.S. Pat. No. 5,547,008, shows a system for opening and closing mini-blinds. Crider et al., U.S. Pat. Nos. 5,566,736, 5,752,557, 5,785,105 and 5,960,847, disclose a roll up closure that utilizes a flexible cover or curtain selected from a material suitable to affect the type closure sought such as against light, ventilation, noise, sound or moisture. The cover is at least as wide as the opening to be covered and is longer than the opening is high. Each lateral margin of the cover has a strip of closure material affixed thereto, and a complimentary strip is affixed to the inside of a channel member. The top of the curtain is rigidly affixed across the top of the opening. The bottom of the curtain is upturned and connected to a driven take up roller mounted atop the opening. An elongated rod is supported within the upturned end of the curtain with its ends captured within the channels on each side of the opening. A weighting rod is supported atop the elongated rod and separated therefrom by the upturned end of the curtain, with the ends of the weighting rod also captured in the lateral channels. Activation of the driven roller lengthens or shortens the effective length of the curtain and moves the rods upwardly within the channels such that the mating closures are positioned to seal and unseal the curtain to the channel.

Anderson et al., U.S. Pat. No. 7,281,561, discloses a window assembly containing multiple layers of flexible film used to effect various open to closed positions. In spite of all the above cited art, Applicants are not aware of a single prior art system that enables a user to regulate the amount of illumination and solar gain generated by a window opening, for example only, with the ability to completely to progressively darken and even "black out" the light entering through the opening with a shade. Further, Applicants are not aware of a prior art system that provides for the creation of multiple layers of shade material from a single length of shade and which provides for gradual adjustment of transmitted light from totally open to totally blacked out.

Thus, there is a need in the art for a system and method for providing an easy to use, easy to maintain room darkening screen for openings, such as for example only, windows. It, therefore, is an object of this invention to provide a room darkening screen for use with openings that allows a user to adjust from fully open to fully blacked out and in between. Further it is an object to provide a system that creates layers of screen or shades from a single length of shade and that is easily adjustable to accommodate openings of different lengths and widths.

SUMMARY OF THE INVENTION

Accordingly, the room darkening screen system of the present invention, according to one embodiment includes a shade roll. A shade with a first end and a second end is provided where the first end is connected with the shade roll and the second end is connected with a bottom bar. A header is connected with the shade roll. A folding rod is connected with the header such that when the folding rod is released from the header the folding rod folds the shade.

As used herein, the term "shade" is given its common meaning. That is, the term, shade, includes screens, curtains, and other similar items. The shade of the present invention may be made from any material now known or hereafter developed that is flexible and strong enough to be rolled and unrolled time and again.

According to another aspect of the invention, a blocker is connected with the shade such that the folding rod is released prior to the bottom bar contacting a stop. In a further aspect, the header is movably and removably connected with a mounting bracket so as to create an open position to provide access to the shade roll and folding rod and the header further includes a lock portion for connection with the mounting bracket such that the header is held in the open position by the lock portion and so that the header may be removed from the mounting bracket and then easily be reattached.

As the terms are used herein, "movably" and "removably" include their common meaning. Still, movably means movable while still being connected with the mounting bracket and removable means removable and, as used herein and as illustrated and described hereafter, reattachable to the mounting bracket.

In another aspect, end caps are connected with the header where the end caps include channels within which the folding rod is releasably retained. In one aspect, a receiving slot is provided in the end caps within which the bottom bar fits when the shade is fully retracted onto the shade roll. In another aspect, a magnet is connected with the header or the mounting bracket such that the magnet releasably holds the header and mounting bracket together.

In a further aspect, the shade includes a first layer connected with the shade roll, a second layer connected with the first layer and a third layer connected with the second layer and with the bottom bar and, further, where the shade is made of a combination of one or more materials selected from a group of materials consisting of transparent material, translucent material, opaque material, and optically polarized material. In another aspect, the first layer is made of material optically polarized in one direction and the second layer is made of material optically polarized in a second direction. In one aspect, the first layer is made of material selected from a group consisting of translucent mesh and perforated material. In another aspect, the third layer is made of translucent material and the second layer and the third layer are made of opaque material.

In still another aspect, the bottom bar and one layer of the shade weighs more than the combined weight of two layers of the shade and the folding rod.

According to another embodiment of the invention, an open loop room darkening screen apparatus includes a mounting bracket. A header is movably and removably connected with the mounting bracket. A shade roll is connected with the header. A shade with a first end and a second end is provided where the first end is connected with the shade roll and the second end is connected with a bottom bar. End caps are connected with the header and the end caps include channels within which a folding rod is releasably retained by the shade.

In another aspect, the folding rod is released from connection with the header when the bottom bar contacts a stop such that the folding rod folds the shade. In another aspect, a blocker is connected with the shade such that the folding rod is released prior to the bottom bar contacting a stop. In a further aspect, the header is movable and removable so as to create an open position to provide access to the shade roll and folding rod, the header further including a lock portion for connection with the mounting bracket such that the header is held in the open position by the lock portion. Further, the header is removable from, and reattachable to, the mounting bracket.

In another aspect, the shade includes a first layer connected with the shade roll, a second layer connected with the first layer and a third layer connected with the second layer and with the bottom bar. In one aspect, the first, second and third layers are made of a combination of one or more materials selected from a group of materials consisting of: transparent material, translucent material, opaque material, and optically polarized material. In another aspect, the bottom bar and one layer of the shade weighs more than the combined weight of two layers of the shade and the folding rod.

According to another embodiment of the invention, a method for selectively darkening an opening includes the steps of: providing a shade roll with a shade with a first end and a second end where the first end is connected with the shade roll and the second end is connected with a bottom bar, with a header connected with the shade roll and with a folding rod connected with the header; attaching the header to an opening; and operating the shade such that the shade is selectively positioned in the opening and such that the folding rod is released when the bottom bar is stopped and said shade is deployed and the folding bar folds the shade and at least partially creates a three layered shade.

In a further aspect, the method includes the steps of: removing the header; cutting the header, the shade roll, the shade, and the folding rod to fit the opening; and replacing the shade role, shade and folding rod within the header.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
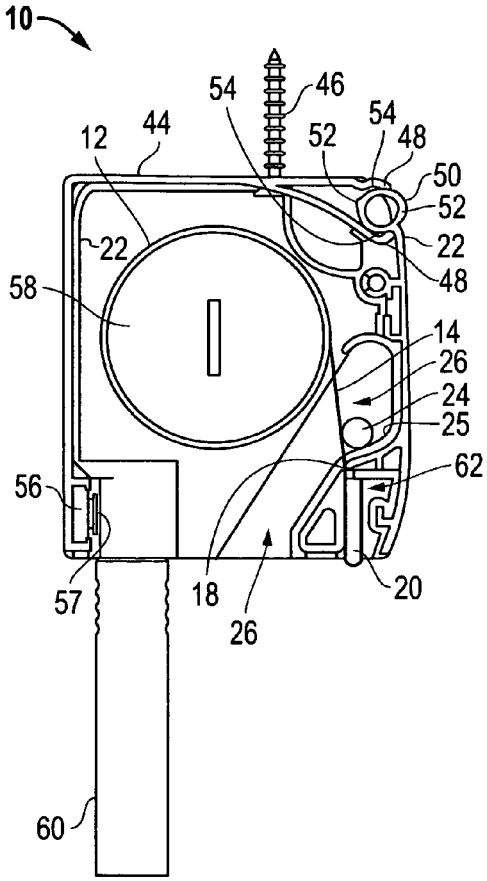
FIG. 1 is a partial cut away end view looking through an end cap of the room darkening screen system according to one embodiment of the invention showing the system in the fully open position.

The preferred embodiment of the present invention is illustrated by way of example in FIGS. 1 through 8. With specific reference to FIGS. 1-4, room darkening screen apparatus 10, according to one embodiment, includes a shade roll 12 with a shade 14 with a first end 16 (not shown) connected with the shade roll 12 and a second end 18 connected with a bottom bar 20. As noted above, shade 14 is any curtain or screen made of any flexible material now known or hereafter developed. Shade 14 may have multiple opacities along its length so as to filter various amounts of light ranging from transparent to translucent to opaque simply by connecting various different materials together as will be more fully described hereafter. Shade 14 is shown in FIG. 1 in its "raised", "start", "transport" or "fully open" position with shade 14 rolled up on shade roll 12 to the maximum extent and bottom bar 20 also fully raised.

Figure 2:
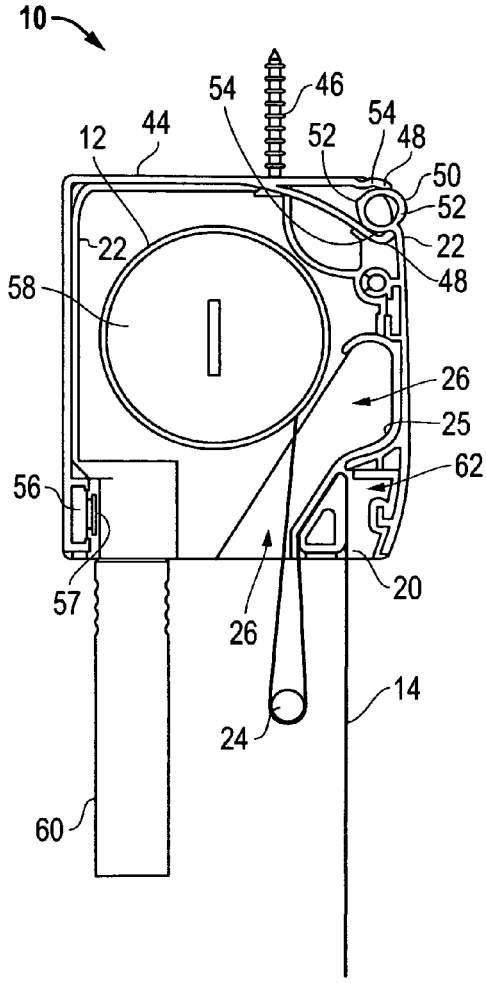
FIG. 2 is a partial cut away end view looking through an end cap showing the bottom bar and folding rod deployed.

FIGS. 1 and 2 show header 22 to which shade roll 12 is connected. Header 22 and shade roll 12 are connected in such a manner that shade roll 12 is held in position within the confines of header 22 as shown but shade roll 12 is free to rotate. Shade roll 12 may be manually operated or connected with a power source and motor, not shown in these figures, of any sort now known or hereafter developed for rotating shade roll 14 as will be described more fully hereafter.

Figure 3:
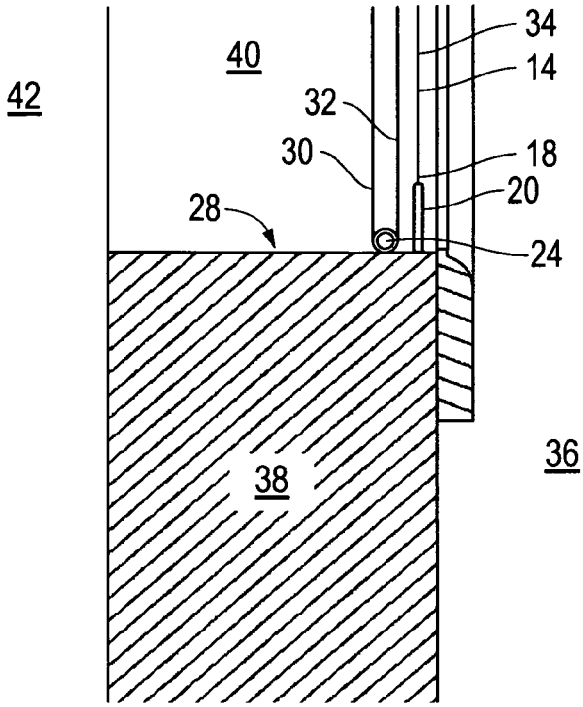
FIG. 3 is a side view showing the bottom bar and the folding rod stopped by the sill of a window.

FIGS. 1 and 2 also illustrate folding rod 24. Folding rod 24 is located in channel 26 of end caps 64 of header 22 as shown in FIG. 1. According to a preferred embodiment, shade 14 holds folding rod 24 on folding rod ledge 25 as shown in FIG. 1 until bottom bar 20 is stopped in its downward motion, such as by window sill 28 as shown in FIG. 3. At that point, upon further deployment of shade 14 folding rod 24 comes out of channel 26 and off of slanted folding rod ledge 25 and folds shade 14 as shown in FIGS. 2 and 3. FIG. 3 shows the shade 14 fully deployed and three layers of shading created by the action of the room darkening screen apparatus 10 as just described and as will be more fully described hereafter. Applicants have determined that folding rod ledge 25 is very useful in holding folding rod 24 in place with just the right amount of pressure on shade 14. The angle of folding rod ledge 25 may be adjusted for maximum effectiveness in accordance with the weight of the folding rod 24 and the type of shade material 14. The exact angle may be determined by trial and error. The angle is correct when the folding rod 24 exerts a minimal pressure on the shade 14 while immediately rolling off of folding rod ledge 25 when tension of the shade against the folding rod 24 is removed as will be described more fully hereafter.

Preferably, channel 26 is formed in an end cap 64 connected with header 22. The figures show a see through view of the end cap 64 so that its structure may be more fully apparent. By use of a combination of two end caps 64, one on each end of header 22, shade roll 14 is fully supported as is folding rod 24.

In the "full black out" position shown in FIG. 3, the three separate layers that have been created out of a single length of shade 14 are clearly illustrated. Starting with the "layer" of shade 14 connected by first end 16 (not shown) to shade roll 12 is first layer 30, then second layer 32 and then third layer 34 with second end 18 connected with bottom bar 20. First layer 30 and second layer 32 are created by the folding rod 24. From the perspective of a person on the inside 36 of a structure 38 with a window opening 40 between the inside 36 of the structure 38 and the outside 42 of the structure 38, the only layer seen is the third layer 34. Third layer 34 is deployed by action of the bottom bar 20 and the weight of third layer 34 which Applicants have determined must preferably together weigh more than the combined weight of two folding layers 30 and 32 of the shade 14 and folding rod 24 in order to function best. Thus, the weight of bottom bar 20 causes it to pull shade 14, third layer 34, with it as it is allowed to move by operation of shade roll 12. As a result, window opening 40 may be fully uncovered, partially covered by third layer 34 or fully covered by third layer 34. Likewise, once bottom bar 20 is stopped by window sill 28, in this embodiment, further operation of shade roll 12 allows folding rod 24 to escape from channel 26 and roll off of folding rod ledge 25 and fold shade 14 into second layer 32 and first layer 30. These layers 32 and 30, located behind third layer 34, from the perspective of a person on the inside 36 of structure 38, enable a person to progressively darken an opening so as to go from an open position, to a partially obscured position with just third layer 34 deployed to a partial black out position with second and first layers 32 and 30 partially lowered to a full black out position as shown in FIG. 3.

These room darkening features may be manipulated by the selection of the same material for the entire length to shade 14 or by mixing and matching materials of different opacities and even different optical polarities. By way of example only and not by limitation, first layer 30 may be made of material with horizontal optical polarity and second layer 32 may be made of material with vertical optical polarity. When fully lowered, a total black out is provided by the combination. Also, third layer 34 may be translucent material to allow light in but provide a shield to prying eyes, for example. Also, the shade 14 may be made of material sufficient to add storm protection to a structure 38 when, for example, bottom bar 20 is secured in position on the window sill 28.

Figure 8:
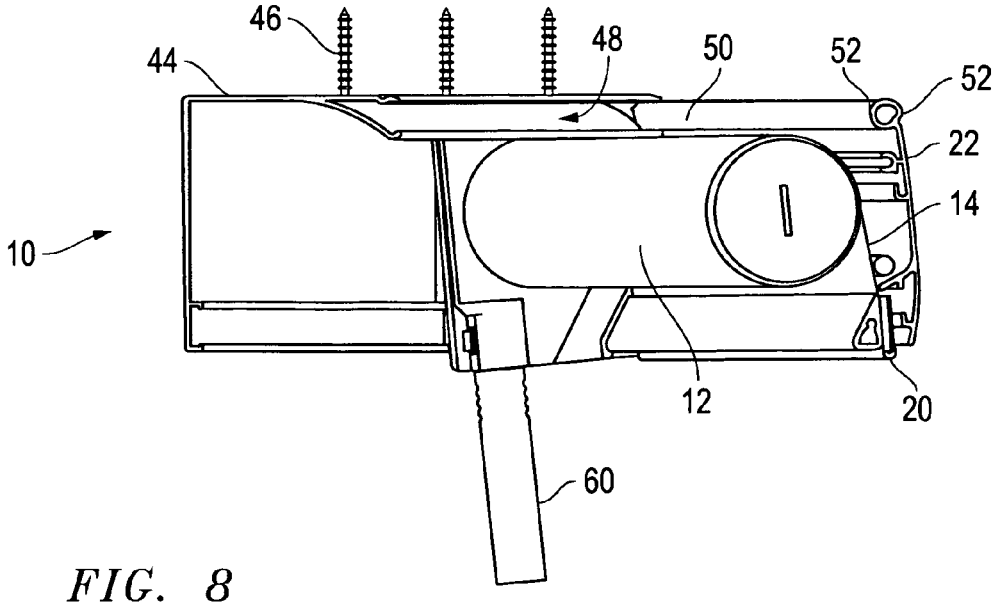
FIG. 8 is a perspective view looking through an end cap showing the header being connected with the mounting bracket.

Referring to FIGS. 1 and 2 again, mounting bracket 44 is shown held in position in the opening 40 of structure 38, not shown, by screws 46 or any other appropriate means now known or hereafter developed. Importantly, header 22 is movably connected with mounting bracket 44, as also illustrated in FIG. 8 among others. That is, mounting bracket 44 is made of aluminum or semi rigid flexible plastic, for example only, and includes a header channel 48 which expands to receive header lip 50 (See also FIG. 8). This feature also allows header 22 to be removably connected with mounting bracket 44 in a manner that holds header 22 securely in place until a user desires to remove the header 22 for cleaning or repair for example only. Heretofore, the prior art required laborious effort to remove a header once connected in an opening either to a mounting bracket or otherwise. This feature is a significant improvement on the art. This feature also allows mounting bracket 44 to be installed easily and, further, allows header 22 to be movably connected with mounting bracket 44. That is, while still connected, header 22 may be moved or rotated and held in place in an easy to access location. In this regard, header lip 50 includes lock portions 52 that cooperate with lock recesses 54 in mounting bracket 44 header channel 48 to hold header assembly 22 in a raised "open" position that will be described more fully with regard to, and is illustrated in, FIG. 4.

FIGS. 1 and 2 also show steel inserts 56 in mounting bracket 44 and magnets 57 in header 22 that cooperate to hold header 22 in the closed position shown in these figures next to mounting bracket 44. Any other system to hold these items in close relation to each other is suitable as well. Also shown is twist retainer 58 connected with shade roll 12 as will be more fully described with regard to FIG. 4. These figures also show removable communication stick 60 for enabling the sending or receipt of electronic signals to the system when connected with the system. Finally, FIGS. 1 and 2 show bottom bar slot 62 in header 22 into which bottom bar 20 fits when in the fully up and/or transport position as shown in FIG. 1.

Figure 4:
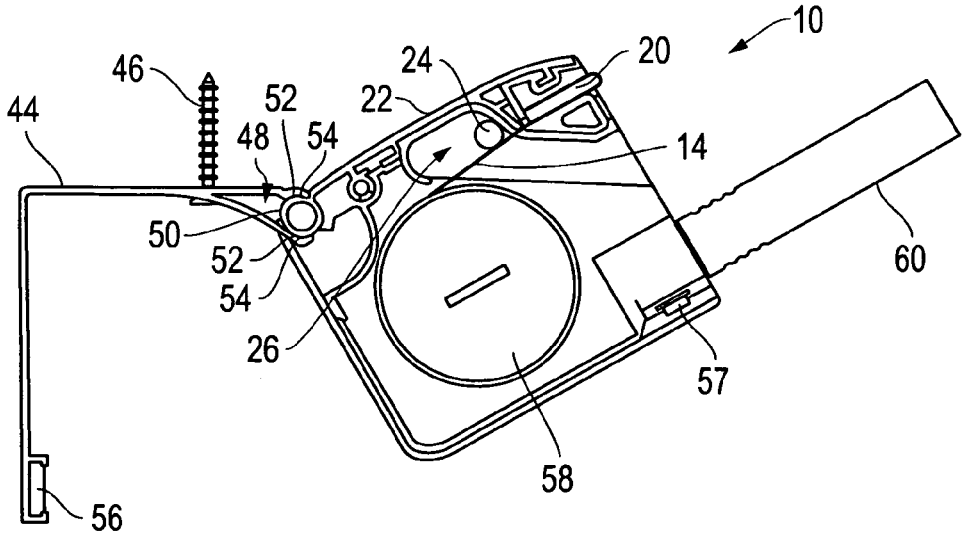
FIG. 4 is an end view looking through an end cap showing the header in the raised open and locked position.

Referring now specifically to FIG. 4, header 22 is shown in the "open" and locked position being held in this position by the cooperation of lock portions 52 and lock recesses 54. End cap 64 covers the open ends of header 22 shown in FIGS. 1 and 2 and center and support shade roll 12. There is an end cap 64 on each end of header 22 although only one is shown in FIG. 4.

Another feature of Applicants' invention is that if the opening 40 is narrower than the apparatus, it is easy to conform the apparatus to the exact required dimensions. A user simply removes the header 22 from its shipping package. Then, the header 22, mounting bracket 44 (if used), shade roll 12, shade 14, and folding rod 24 are simply cut to the proper width of opening 40. Care must be taken to avoid damage to any other additional elements which may be included such as communication stick 60, of course. Then these elements are reconnected, the mounting bracket 44 attached in the opening and the header 22 connected with the mounting bracket 44 and the apparatus is custom fit to the opening in a quick and easy process. FIG. 8 in particular shows how header lip 50 of header 22 is simply inserted into header channel 48 of mounting bracket 44 so as to form a movable and easily removable connection, for example only.

Figure 5:
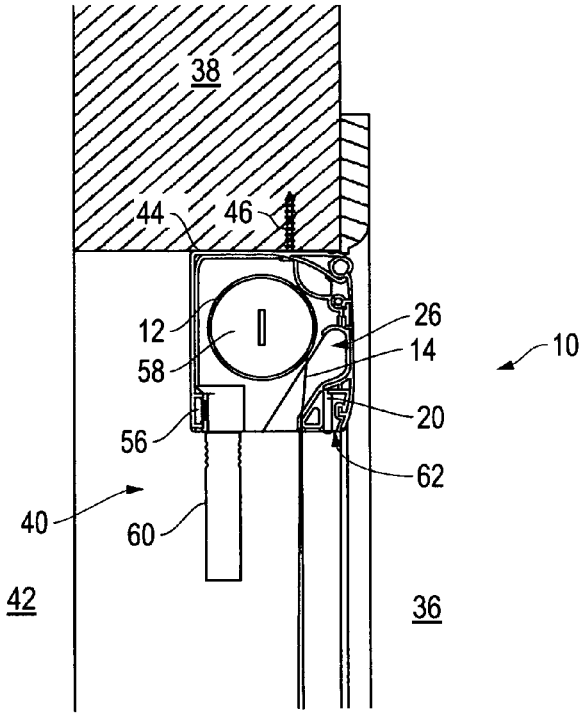
FIG. 5 is an end sectional view looking through an end cap showing the bottom bar in the start position as in FIG. 1 with the folding rod deployed.
Figure 6:
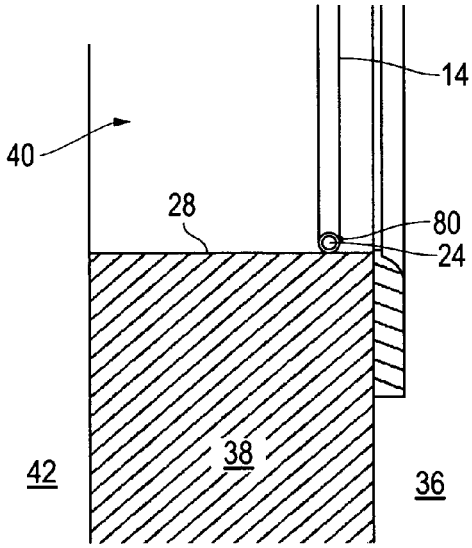
FIG. 6 is an end sectional view showing the folding rod at rest on a window sill and a blocker added to the shade.
Figure 7:
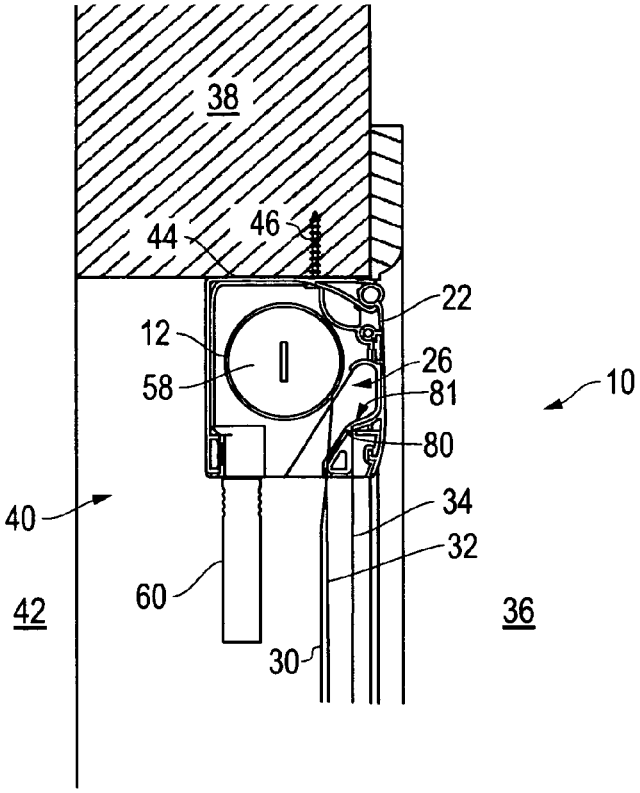
FIG. 7 is an end sectional view looking through an end cap showing the bottom bar deployed and the blocker tape acting to release the folding rod.

Referring now to FIGS. 5, 6 and 7 another feature of the Applicants' apparatus is disclosed where it is shown how to cause folding rod 24 to drop out of channel 26 when desired, even before bottom bar 20 is stopped as described above. FIG. 1 shows the start or open position. FIG. 5 shows bottom bar 20 held in place in bottom bar slot 62 of end caps 64. This can be done manually or by action of friction between the bottom bar 20 and bottom bar slot 62. In any case, rotation of shade roll 12 manually or mechanically while the bottom bar is stopped releases tension on shade 14 that is holding folding rod 24 in place on folding rod ledge 25 and allows folding rod 24 to leave channel 26 and folding rod ledge 25 and fold shade 14 as shown. FIG. 6, shows folding rod 24 at rest at window sill 28. At that position, a blocker 80 is attached to shade 14. Blocker 80 may be a piece of tape or any other form of blocker desired.

Referring to FIG. 7, the operation of blocker 80 is shown in that as shade 14 is allowed to unroll from shade roll 12, bottom bar 20 pulls shade 14 down until blocker 80 engages header 22 as shown and prevents bottom bar 20 from going further. That is, blocker 80 is larger than the passageway 81 through which shade 34/14 passes. This stops shade 34/14 from descending, just as occurs when the bottom bar 20 is stopped by window sill 28, for example only. This releases shade 34/14 from tension against folding rod 24. This thus allows folding rod 24 to leave channel 26 and folding rod ledge 25 and create a fold in shade 14 as described above. That is, once blocker 80 stops shade 34/14, as shade roll 12 continues to unroll shade 14, folding rod 24 is released from channel 26 and folding rod ledge 25 and as folding rod 24 deploys or descends, it creates first layer 30 and second layer 32 at least partially behind third layer 34. This feature enables even more lighting options when various stop positions for bottom bar 20 and various shade materials are adopted.

By way of continued explanation, Applicants have determined that the present invention has many advantages over prior art systems including but not limited to the following:

The "open loop" deployment of the shade 14 allows a user to go from no shade to a reduced vision shade and continue on to a total black out opening cover using a single length of shade 14.

The shade 14 can retract to a full open, non-shaded position, where no portion of the shade 14 is visible as well as fully deployed to create a total black out condition.

The shade 14 can develop up to three layers of curtain material for greater optical density.

The apparatus provides a predictable method of retaining and deploying the folding rod 24.

The shade assembly 10 has "cut down" in width or length adjustment capability.

The apparatus 10 does not require removal of the header assembly 22 to service the any elements located within header 22.

The apparatus 10 does not require disassembling the header assembly 22 to service the any elements located within header 22.

Apparatus 10 includes a lock position on the header 22 to hold the movable portion of the assembly, header 22, so as to facilitate easy servicing of the interior elements of the apparatus.

The use of a blocker tape 80 to limit the amount of the inward shade's 14 downward travel enables the user to deploy the additional layers earlier.

In an electric motor version, a circuit board that controls the unit can be compactly contained in the shade roll 12 or the end cap 64.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A room darkening screen apparatus comprising:

a. a shade roll;

b. a shade with a first end and a second end wherein the first end is connected with the shade roll and the second end is connected with a bottom bar which is vertically movable relative to the first end;

c. a header connected with the shade roll;

d. a folding rod connected with the header wherein said folding rod, when released from the header, folds said shade; and e. end caps connected with the header wherein said end caps include channels within which the folding rod is releasably retained.

2. The apparatus of claim 1 further including a blocker connected with said shade for stopping said bottom bar such that said folding rod is released prior to the bottom bar contacting a stop.

3. The apparatus of claim 1 wherein said header is movably and removably connected with a mounting bracket so as to create an open position to provide access to said shade roll and folding rod, said header further including a lock portion for connection with said mounting bracket such that said header is held in said open position by said lock portion, and said mounting bracket further including a header channel conformed to accommodate a header lip such that said header is removable from said mounting bracket.

4. The apparatus of claim 1 further including a receiving slot in said end caps within which said bottom bar fits when said shade is fully retracted.

5. The apparatus of claim 1 further including a magnet connected with said header or said mounting bracket such that said magnet releasably holds said header and said mounting bracket together.

6. The apparatus of claim 1 wherein said shade includes a first layer connected with said shade roll, a second layer connected with said first layer and a third layer connected with said second layer and with said bottom bar and wherein said shade is made of a combination of one or more materials selected from a group of materials consisting of: transparent material, translucent material, opaque material, and optically polarized material.

7. The apparatus of claim 6 wherein the first layer is made of material optically polarized in one direction and the second layer is made of material optically polarized in a second direction.

8. The apparatus of claim 6 wherein said first layer is made of material selected from a group consisting of translucent mesh and perforated material.

9. The apparatus of claim 6 wherein said third layer is made of translucent material and said second layer and said first layer are made of opaque material.

10. The apparatus of claim 1 wherein said bottom bar and the weight of one layer of shade weighs more than the combined weight of two layers of the shade and the folding rod.

11. An open loop, room darkening screen apparatus comprising:

a. a mounting bracket;

b. a header, with a folding rod ledge, movably connected with the mounting bracket;

c. a shade roll connected with the header;

d. a shade with a first end and a second end wherein the first end is connected with the shade roll and the second end is connected with a bottom bar which is vertically movable relative to the first end;

e. end caps connected with the header wherein said end caps include channels; and e. a folding rod releasably retained on said folding rod ledge by the shade.

12. The apparatus of claim 11 wherein said folding rod is released from connection with the header when said bottom bar is stopped and said shade is deployed such that said folding rod folds said shade.

13. The apparatus of claim 12 further including a blocker connected with said shade, for stopping said bottom bar prior to the bottom bar contacting a stop, such that the folding rod is released.

14. The apparatus of claim 11 wherein said header is movable and removable so as to create an open position to provide access to said shade roll and folding rod, said header further including a lock portion for connection with said mounting bracket such that said header is held in said open position by said lock portion and said mounting bracket further including a header channel conformed to accommodate a header lip such that said header is removable from said mounting bracket.

15. The apparatus of claim 11 wherein said shade includes a first layer connected with said shade roll, a second layer connected with said first layer and a third layer connected with said second layer and with said bottom bar.

16. The apparatus of claim 15 wherein the first, second and third layers are made of a combination of one or more materials selected from a group of materials consisting of: transparent material, translucent material, opaque material, and optically polarized material.

17. The apparatus of claim 11 wherein said bottom bar and one layer of shade weighs more than the combined weight of two layers of the shade and the folding rod.

18. A method for selectively darkening an opening comprising:

a. providing a shade roll with a shade with a first end and a second end wherein the first end is connected with the shade roll and the second end is connected with a bottom bar, with a header connected with the shade roll and with a folding rod connected with the header;

b. attaching the header to an opening; and c. operating the shade roll such that said shade is selectively positioned in the opening and such that the folding rod is released when the bottom bar is stopped and said shade is deployed such that the folding bar folds the shade and creates a three layered shade.

19. The method of claim 18 further comprising the steps of:

a. removing said header;

b. cutting said header, said shade role, said shade, and said folding rod to fit said opening; and c. replacing said shade role, shade and folding rod within said header.

20. A room darkening screen apparatus comprising:

a. a shade roll;

b. a shade with a first end and a second end wherein the first end is connected with the shade roll and the second end is connected with a bottom bar;

c. a header connected with the shade roll; and d. a folding rod connected with the header by rotation of said shade roll wherein said folding rod, when released from the header, folds said shade and wherein said bottom bar and the weight of one layer of shade weighs more than the combined weight of two layers of the shade and the folding rod.

* * * * *